United States Patent [19]

Yamaguchi

[11] Patent Number: 4,674,207

[45] Date of Patent: Jun. 23, 1987

[54] BASEBALL SHOE

[75] Inventor: Mitsuhiro Yamaguchi, Nishinomiya, Japan

[73] Assignee: Morito Co., Ltd., Osaka, Japan

[21] Appl. No.: 874,341

[22] Filed: Jun. 13, 1986

[30] Foreign Application Priority Data

Oct. 14, 1985 [JP] Japan ..... 60-157343[U]

[51] Int. Cl.[4] ..... A43B 5/00; A43C 15/00

[52] U.S. Cl. ..... 36/126; 36/67 R; 36/134

[58] Field of Search ..... 36/126, 134, 67 R, 67 A, 36/67 B, 67 D

[56] References Cited

U.S. PATENT DOCUMENTS

| | | | |
|---|---|---|---|
| 1,923,365 | 8/1933 | Gaines | 36/126 |
| 2,268,992 | 1/1942 | Nofziger | 36/134 X |
| 3,522,669 | 8/1970 | Simons . | |
| 4,445,288 | 5/1984 | Fror | 36/134 |

FOREIGN PATENT DOCUMENTS

| | | | |
|---|---|---|---|
| 2826968 | 1/1980 | Fed. Rep. of Germany | 36/126 |
| 3134817 | 3/1983 | Fed. Rep. of Germany | 36/126 |
| 3233900 | 3/1984 | Fed. Rep. of Germany | 36/67 R |
| 58-15074 | 1/1983 | Japan | 36/134 |
| 58-15075 | 1/1983 | Japan | 36/134 |

*Primary Examiner*—James Kee Chi

*Attorney, Agent, or Firm*—Trexler, Bushnell, Giangiorgi & Blackstone, Ltd.

[57] ABSTRACT

A baseball shoe comprising spikes (S) with ceramic teeth (t) embedded in resin flanges (f), a resin sole body (A) having the spikes (S) embedded therein, and an upper shoe portion. Each tooth (t) includes a tooth body (3) and a seat plate portion (5) connected thereto. Each flange (f) includes an embedment portion (6) having the seat plate portion (5) of the tooth (t) embedded therein and a thinner peripheral portion (8) positioned around the embedment portion (6). The material of the sole body (A) is softer than that of the flanges (f) of the spikes (S).

8 Claims, 11 Drawing Figures

BASEBALL SHOE

FIELD OF THE INVENTION AND RELATED ARTS

The present invention relates to a baseball shoe having attached thereto spikes having teeth made of ceramic material.

A conventional baseball shoe has spikes attached to the sole thereof, wherein a plurality of teeth made by bending steel plates are employed. These spikes, however, have the drawback of being inferior in wear resistance. To eliminate this drawback, baseball shoes having attached thereto spikes having teeth made of ceramic material have been produced. However, many of these shoes arouse a sense of upward thrust due to the spikes during use and have another drawback of the teeth being liable to crack; thus, they have not been completely satisfactory.

OBJECTS AND SUMMARY OF THE INVENTION

An object of the present invention is to provide a shoe which will not arouse a sense of upward thrust due to spikes during use and which is superior in durability.

A baseball shoe according to the invention comprises spikes with ceramic teeth embedded in resin flanges, each tooth including a tooth body and a seat plate portion connected thereto, each flange including an embedment portion having the seat plate portion of the tooth embedded therein and a thinner peripheral portion positioned around said embedment portion; a resin sole body having said spikes embedded therein; the material of said sole body being softer than that of the flanges of said spikes; and an upper shoe portion.

In the baseball shoe of the present invention, the forces applied to each tooth body during use is transmitted through the seat plate portion to the entire flange and then distributed to the shoe sole, so that there is aroused no sense of upward thrust due to the spikes. Further stress concentration on the teeth during use is relieved, so that the tooth bodies will not break or crack. Thus the shoe is superior in durability, fully exploiting the wear resistance of the ceramics.

Preferably, the ceramic material of the spikes is zirconium oxide containing 3–20 mole percent yttrium oxide.

Preferably, the material of the flanges having the spike teeth embedded therein is rigid urethane or polyacetal.

Preferably, the seat plate portion of the tooth is provided with integrating means for integration with the flange resin. The integrating means may be throughgoing holes, projections or notches or combinations thereof. With this arrangement, the seat plate portion of the tooth is surrounded by the flange resin, so that the tooth and the flange are firmly integrated.

Preferably, the flange is provided with integrating means for integration with the shoe sole body resin. This integrating means may be in the form of throughgoing holes, projections, notches or combinations thereof. With this arrangement, the peripheral portion of the flange is surrounded by the shoe sole body resin, so that the flange and the shoe sole body are firmly integrated.

Since the tooth and the flange on the one hand and the flange and the shoe sole body on the other hand are firmly integrated in this manner, the possibility of a clearance being defined therebetween can be precluded.

As a result, there is no danger of sand entering such a clearance or of the teeth being shaken to have their life shortened.

Preferably, a plurality of flanges are interconnected by a connecting plate. With this arrangement, as compared with the use of independent spikes, the trouble of disposing said spikes in a metal mold in molding the shoe sole body is alleviated and the teeth can be disposed more firmly in the shoe sole. Further, forces applied to the teeth are distributed over the entire shoe sole and forces unevenly applied to the teeth by the unevenness of the ground are more absorbed, whereby the sense of wearing shoes is more improved.

BRIEF DESCRIPTION OF THE DRAWINGS

The invention will now be described with reference to the accompanying drawings in which.

DETAILED DESCRIPTION OF PREFERRED EMBODIMENTS

Figure 1:
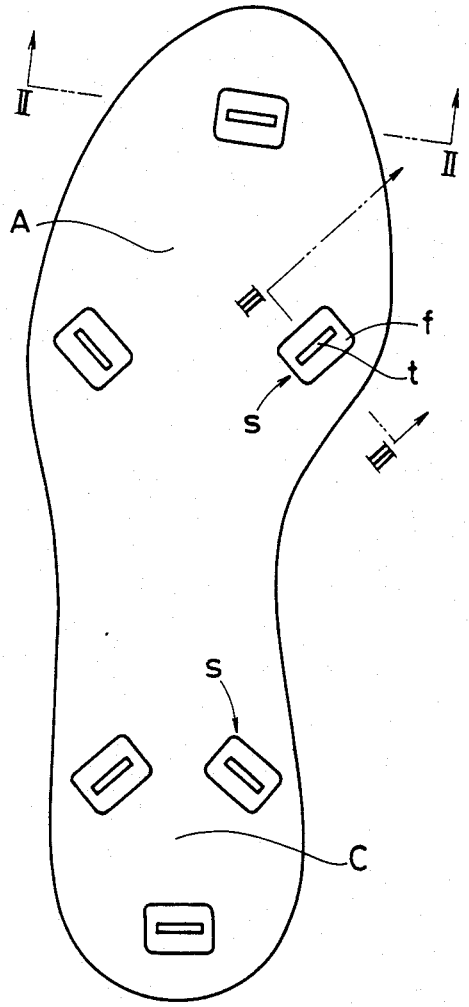
FIG. 1 is a bottom view of a baseball shoe according to a first embodiment of the invention.
Figure 2:
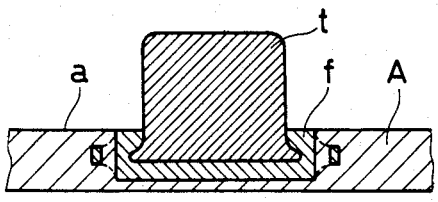
FIG. 2 is an enlarged fragmentary sectional view taken along the line 2—2 in FIG. 1.
Figure 3:
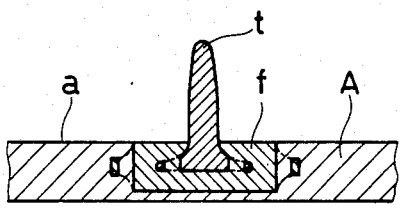
FIG. 3 is an enlarged fragmentary sectional view taken along the line 3—3 in FIG. 1.

A baseball shoe according to the invention, as shown in FIGS. 1 through 3, comprises a shoe sole body A having spikes S embedded therein, and a usual upper shoe portion (not shown) including an intermediate layer and an instep strap.

Figure 6:
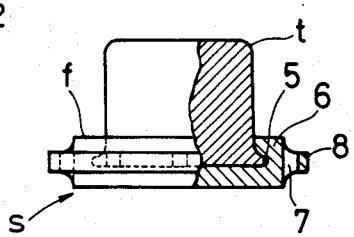
FIG. 6 is a front view, partly broken away, of a spike of the invention.
Figure 7:
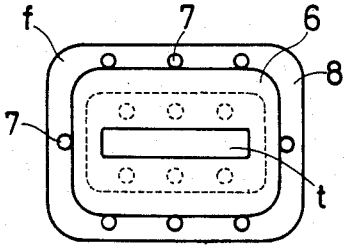
FIG. 7 is a plan view of a spike in the first embodiment of the invention.

The spike S, as shown in FIGS. 6 and 7, is formed by embedding the seat plate portion 5 of a ceramic tooth t in the embedment portion 6 of a flange f of rigid synthetic resin.

Figure 4:
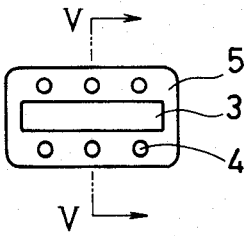
FIG. 4 is a plan view of a tooth in the first embodiment of the invention.
Figure 5:
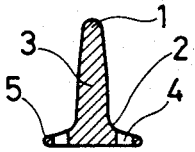
FIG. 5 is a sectional view taken along the line 5—5 in FIG. 4.

The ceramic tooth t, as shown in FIGS. 4 and 5, has a tooth body 3 in plate form which has a rounded front end 1 and a root portion 2 and which is connected to a seat plate portion 5 having a plurality of throughgoing holes 4. The material of the teeth t is not particularly limited provided that it is ceramic, but alumina or zirconia type ceramic material is preferable. The most preferable material is zirconium oxide containing 3–20 molar percent yttrium oxide.

The flange f, as shown in FIGS. 6 and 7, has a thinner peripheral portion 8 formed around the embedment portion 6 having the seat plate portion 5 of the tooth embedded therein. The peripheral portion 8 is preferably trapezoidal in cross section with the upper and lower sides cut. The peripheral portion 8 is preferably formed with a plurality of throughgoing holes 7. The flanges f are preferably molded of tough rigid synthetic resin, such as rigid urethane or polyacetal.

The shoe sole body A has toughness and is made of a material softer than that of the flanges f of the spikes. Particularly, such synthetic resins as urethane and nylon are preferable.

The method of producing baseball shoes according to the invention will now be described. A plastic tooth t produced in advance is disposed in a metal mold for a flange f, and rigid synthetic resin is poured into the mold, thereby producing a spike S having a tooth t body 3 projecting from the embedment portion 6 of the flange f. These spikes S are disposed in a metal mold for forming a shoe sole body A, and tough synthetic resin is poured into the mold, thereby producing a shoe sole with the spikes S and shoe sole body A integrated such that the tooth bodies 3 alone project from a ground-engaging surface a. Finally, by the usual method, an intermediate layer and an instep strap are disposed on this shoe sole to produce a shoe.

Figure 8:
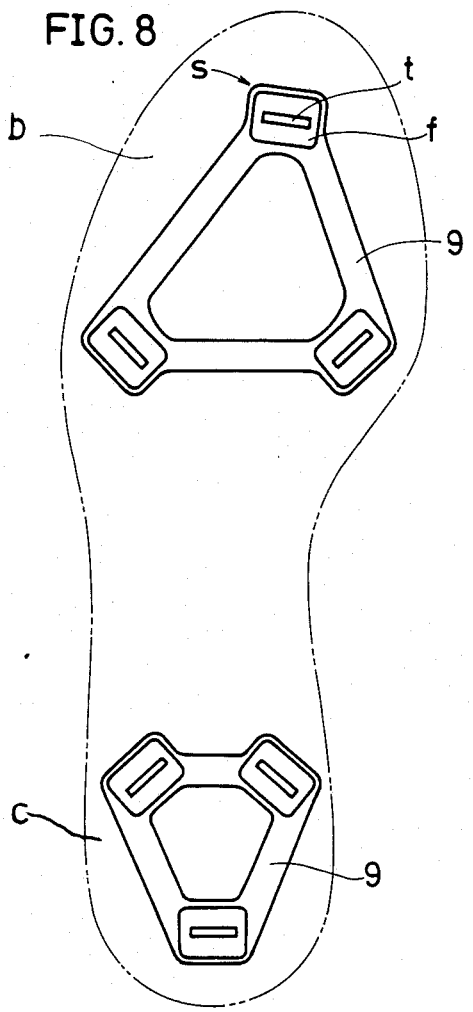
FIG. 8 is a plan view of spikes according to another embodiment of the invention.
Figure 9:
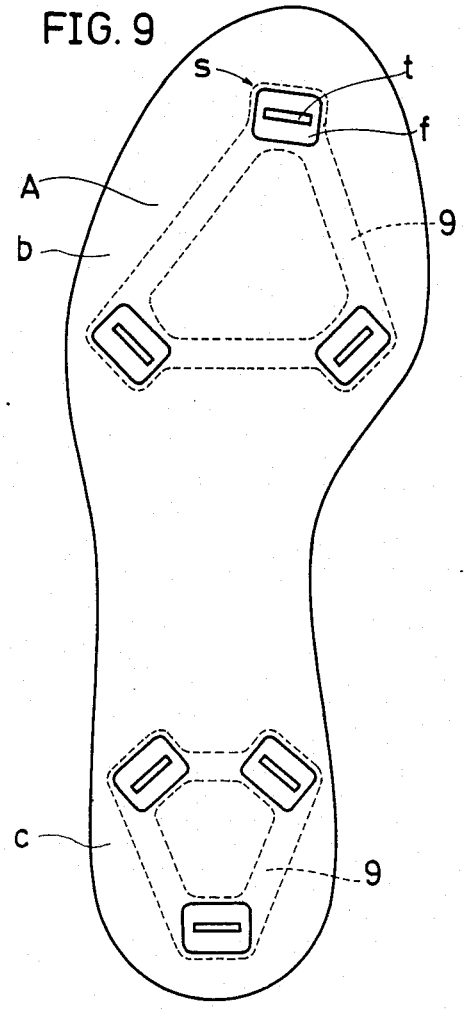
FIG. 9 is a bottom view of the sole of a baseball shoe having the spikes of FIG. 8 embedded therein.

In another embodiment, as shown in FIGS. 8 and 9, three flanges f each having a tooth t embedded therein are integrated by being interconnected by a connecting plate 9. Such groups of integrated spikes S are embedded in the shoe sole body, one at the front step portion b and the other at the heel portion c of the shoe sole.

Figure 10:
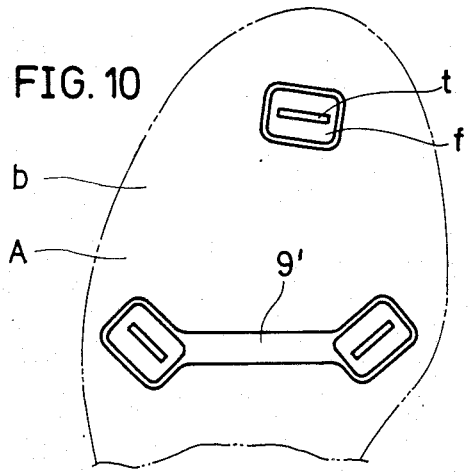
FIG. 10 is a front view of spikes according to a further embodiment of the invention.

In a further embodiment of the invention, as shown in FIG. 10, a combination spike with two flanges f each having a tooth t embedded therein and integrated by being interconnected by a connecting plate 9' is used together with a single spike. And these two types of spikes are embedded in the shoe sole body A at the front step portion b of the shoe sole.

Figure 11:
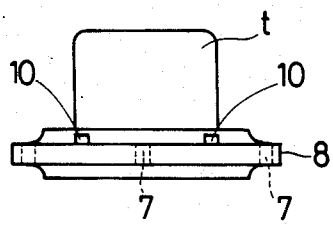
FIG. 11 is a front view of a spike according to another embodiment of the invention.

In yet another embodiment, as shown in FIG. 11, the peripheral portion 8 of the flange f is formed with a plurality of throughgoing holes 7 and a plurality of projections 10 alternating with said holes in such a manner as to surround the embedment portion 6 of the flange f. In this case, the level of the projections 10 on the perpheral portion 8 of the flange f may be lower or higher than the surface of the embedment portion 6 of the flange f. In the case where the level of the projections 10 on the peripheral portion 8 of the flange f is higher than the surface of the embedment portion 6 of the flange f, the length of the projections 10 may be such that when the flange f is embedded in the shoe sole body A, the front ends of the projections 10 project somewhat from the ground-engaging surface a of the shoe sole body A. The front ends projecting from the ground-engaging portion a of the shoe sole body A may be crimped.

In still a further embodiment, the throughgoing holes 7 or projections 10 may be replaced by notches formed around the outer periphery of the peripheral portion 8.

In another embodiment, the throughgoing holes 4 in the seat plate portion 5 of the tooth t may be replaced by projections or notches or combinations thereof.

In another embodiment, a baseball shoe for use on an artificial lawn may be provided which uses teeth t wherein frusto-conical tooth bodies 3 project from the seat plate portion 5.

In another embodiment, a baseball shoe may be provided which uses a tooth t having a plate-like tooth body 3 and a tooth t having a frusto-conical tooth body 3.

It is to be understood that the invention is not limited to the precise embodiments described above and that minor modifications may be made within the scope of the invention.

What is claimed is:

1. A baseball shoe with ceramic spikes comprising: a plurality of ceramic, spike-like teeth; a plurality of resin flanges having said teeth embedded respectively therein; and a resin shoe sole body having said flanges embedded therein; wherein each of said teeth includes a tooth body portion and a seat plate portion, said seat plate portion being provided with integral means for affixing the seat plate portion to the flange; wherein each flange includes an embedment portion for receiving the seat plate portion of the tooth embedded therein and a thinner peripheral portion positioned around said embedment portion, and means integral with the peripheral portion for affixing the flange to the shoe sole body; the resin material of said sole body being softer than that of the flanges, and a shoe upper portion.

2. A baseball shoe as set forth in claim 1, wherein the ceramic material of the spike teeth is zirconium oxide containing 3–20 molar percent yttrium oxide and substantially free of aluminum oxide.

3. A baseball shoe as set forth in claim 1, wherein the flanges for embedding the spike teeth therein are made of rigid urethane or polyacetal and the shoe sole body for embedding the flange is made of urethane or nylon.

4. A baseball shoe as set forth in claim 1, wherein a plurality of flanges are interconnected by a connecting plate.

5. A baseball shoe as set forth in claim 4, wherein the thinner peripheral portion positioned around said embedment portion is trapezoidal in cross-section with the upper and lower sides thereof angled to define said trapezoidal cross-section.

6. A baseball shoe as set forth in claim 1, wherein the means for affixing seat plate portion of each tooth to the flange is in the form of throughgoing holes, projections, notches or a combination thereof in the peripheral portion of the seat plate.

7. A baseball shoe as set forth in claim 1, wherein the means for affixing the flange to the shoe sole body is in the form of throughgoing holes, projections, notches or a combination thereof in the peripheral portion of the flange.

8. A baseball shoe with ceramic spikes comprising: a plurality of ceramic, spike-like teeth of zirconium oxide containing 3–20 molar percent yttrium oxide and substantially no aluminum oxide; a plurality of resin flanges having said teeth respectively embedded therein, and a resin shoe sole body having said flanges embedded therein; wherein each of said teeth includes a tooth body portion and a seat plate portion connected thereto, said seat plate portion of each tooth being provided with integral means for affixing the seat plate portion to the flange, and wherein each flange includes an embedment portion having the seat plate portion of the tooth embedded therein, and a thinner peripheral portion positioned around said embedment portion; said peripheral portion having integral means for affixing the flange to the shoe sole body; the resin material of said sole body being softer than that of the flange; and a shoe upper portion.

* * * * *